US007140852B2

(12) United States Patent
Koide et al.

(10) Patent No.: US 7,140,852 B2
(45) Date of Patent: Nov. 28, 2006

(54) SCROLL COMPRESSOR HAVING AN OIL RESERVOIR SURROUNDING THE DISCHARGE CHAMBER AND AN OIL SEPARATOR IN THE REAR HOUSING

(75) Inventors: Tatsuya Koide, Kariya (JP); Ken Suitou, Kariya (JP); Kazuya Kimura, Kariya (JP); Norimichi Kii, Kariya (JP)

(73) Assignee: Kabushiki Kaisha Toyota Jidoshokki, Kariya (JP)

( * ) Notice: Subject to any disclaimer, the term of this patent is extended or adjusted under 35 U.S.C. 154(b) by 0 days.

(21) Appl. No.: 11/325,870

(22) Filed: Jan. 5, 2006

(65) Prior Publication Data

US 2006/0153725 A1 Jul. 13, 2006

(30) Foreign Application Priority Data

Jan. 11, 2005 (JP) ..... P2005-003941
Oct. 17, 2005 (JP) ..... P2005-302198

(51) Int. Cl.
*F03C 2/00* (2006.01)
*F04C 18/00* (2006.01)

(52) U.S. Cl. ..... 418/55.5; 418/55.1; 418/55.6; 418/57; 418/DIG. 1; 184/6.17

(58) Field of Classification Search ..... 418/55.5, 418/57, 55.6, 55.4, 97, DIG. 1; 55/459.1, 55/460, 423, 467; 184/6.17
See application file for complete search history.

(56) References Cited

U.S. PATENT DOCUMENTS 4,314,796 A * 2/1982 Terauchi ..... 418/57
4,470,778 A * 9/1984 Mabe ..... 418/DIG. 1
4,892,469 A 1/1990 McCullough et al.
5,683,237 A * 11/1997 Hagiwara et al. ..... 418/55.2
6,129,532 A * 10/2000 Kato et al. ..... 418/97
6,152,713 A * 11/2000 Hisanaga et al. ..... 418/55.2
6,227,831 B1 * 5/2001 Osima et al. ..... 418/DIG. 1
6,672,101 B1 * 1/2004 Gennami et al. ..... 418/94
2004/0148947 A1 8/2004 Ota et al.
2004/0191083 A1 9/2004 Gennami et al.

FOREIGN PATENT DOCUMENTS

JP 2003129975 5/2003
JP 2004-301090 10/2004
JP 2004301090 10/2004

* cited by examiner

*Primary Examiner*—Theresa Trieu
(74) *Attorney, Agent, or Firm*—Knoble Yoshida & Dunleavy, LLC

(57) ABSTRACT

A scroll compressor includes a housing, a discharge passage, a rotary shaft, a fixed scroll, a movable scroll, an oil separator and an oil reservoir for compressing refrigerant gas containing lubricating oil. The housing has a rear housing which has a partition wall. The discharge passage is formed in the housing. The discharge passage has a discharge chamber, a discharge hole and an accommodation chamber. The discharge chamber and the accommodation chamber are communicated with each other through the discharge hole. The oil separator is provided in the accommodation chamber. The oil separator has a separation member and an oil reserved area. The oil reservoir is defined around an entire circumference of the partition wall which defines the discharge chamber therein. The oil reservoir is formed so as to communicate with the oil reserved area of the oil separator.

9 Claims, 3 Drawing Sheets

SCROLL COMPRESSOR HAVING AN OIL RESERVOIR SURROUNDING THE DISCHARGE CHAMBER AND AN OIL SEPARATOR IN THE REAR HOUSING

BACKGROUND OF THE INVENTION

The present invention relates to a scroll compressor in which a plurality of compression chambers is moved with reducing volume reduced by orbital motion of a movable scroll of the compressor to draw refrigerant gas from a suction chamber to the compression chambers and then to discharge the refrigerant gas compressed in the compression chambers into a discharge chamber.

In a conventional electric scroll compressor for a vehicle air conditioning apparatus, its housing is so formed that a front housing is joined to a rear housing. A fixed scroll which is fixed to the front housing and a movable scroll which faces the fixed scroll are provided in the front housing. In addition, the front housing has a motor chamber defined therein, and in the motor chamber an electric motor is disposed. The front housing also has a suction passage formed on a lower portion thereof so as to communicate with the motor chamber.

The front housing also has a suction chamber defined therein, and the suction chamber is formed so as to communicate with the motor chamber through the suction passage. As the electric motor is operated to rotate the movable scroll around the central axis of the fixed scroll, a plurality of compression chambers formed between spiral walls of both scrolls are moved toward the center of both spiral walls with decreasing in volume thereof. During the above motion of the compression chambers, refrigerant gas is introduced into the suction chamber through the motor chamber and the suction passage and introduced from the suction chamber into the compression chambers to be compressed in the compression chambers.

The refrigerant gas compressed in the compression chambers is discharged into a discharge chamber defined by the fixed scroll and the rear housing in the housing. The refrigerant gas discharged into the discharge chamber includes lubricating oil which circulates in the housing for lubricating drive mechanism for rotating the movable scroll around the central axis of the fixed scroll. In order to avoid the lubricating oil in the refrigerant gas in the electric scroll compressor from escaping into an external refrigerant circuit of the vehicle air conditioning apparatus, an oil separator is provided in a discharge passage of the refrigerant gas. Japanese Unexamined Patent Publication No,. 2004-301090 discloses one example. If the lubricating oil is taken into the external refrigerant circuit, the lubricating oil adheres to, for example, the inner wall surface of a gas cooler or an evaporator to reduce the efficiency of heat exchange.

The above oil separator is provided with, for example, a centrifugal oil separator which separates the lubricating oil from the refrigerant gas by centrifugal separation caused by circling motion of the refrigerant gas to introduce only the refrigerant gas into the external refrigerant circuit. The lubricating oil separated from the refrigerant gas falls from the oil separator to be temporarily reserved in a lower portion of the oil separator and then returned into a back pressure chamber which is lower in pressure than the discharge chamber through a passage. The lubricating oil which has lubricated the drive mechanism in the back pressure chamber is introduced into an oil reservoir through a passage. In a region between the fixed scroll and the rear housing, the oil reservoir is defined on an outer peripheral side of the discharge chamber.

Meanwhile, in the region between the fixed scroll and the rear housing, the suction passage is formed on the lower portion of the outer peripheral side of the discharge chamber. The suction passage is surrounded by a gasket to prevent the refrigerant gas circulating in the suction passage from leaking into the oil reservoir. Therefore, the region on the outer peripheral side of the discharge chamber is partly occupied by the suction passage and is only partly occupied by the oil reservoir. Specifically, the oil reservoir can be secured only on the upside region of the gasket.

SUMMARY OF THE INVENTION

The present invention is directed to a scroll compressor in which volume of an oil reservoir is increased to increase an amount of lubricating oil reserved in the oil reservoir.

In accordance with an aspect of the present invention, a scroll compressor includes a housing, a discharge passage, a rotary shaft, a fixed scroll, a movable scroll, an oil separator and an oil reservoir for compressing refrigerant gas containing lubricating oil. The housing has a front housing and a rear housing which has a partition wall. The housing also has a suction chamber. The discharge passage is formed in the housing. The discharge passage has a discharge chamber, a discharge hole and an accommodation chamber. The discharge chamber and the accommodation chamber are communicated with each other through the discharge hole. The rotary shaft is rotatably supported by the housing. The fixed scroll is disposed in the housing. The fixed scroll has a fixed scroll base plate and a fixed scroll spiral wall that extends from the fixed scroll base plate. A back pressure chamber is defined in the movable scroll on the opposite side of the fixed scroll. The back pressure chamber is formed so as to communicate with the oil reserved area of the oil separator through an oil feeding passage. At least a part of a wall which forms the oil feeding passage in the rear housing is also used as a part of the partition wall. The movable scroll is also disposed in the housing for facing the fixed scroll. The movable scroll has a movable scroll base plate and a movable scroll spiral wall that extends from the movable scroll base plate. The movable scroll base plate and the movable scroll spiral wall of the movable scroll and the fixed scroll base plate and the fixed scroll spiral wall of the fixed scroll define a compression region therebetween. The oil separator is provided in the accommodation chamber. The oil separator has a separation member and an oil reserved area. The oil reservoir is defined around an entire circumference of the partition wall which defines the discharge chamber therein. The oil reservoir is formed so as to communicate with the oil reserved area of the oil separator.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments, together with the accompanying drawing, in which:

DETAILED DESCRIPTION OF THE PREFERRED EMBODIMENTS

Figure 1:
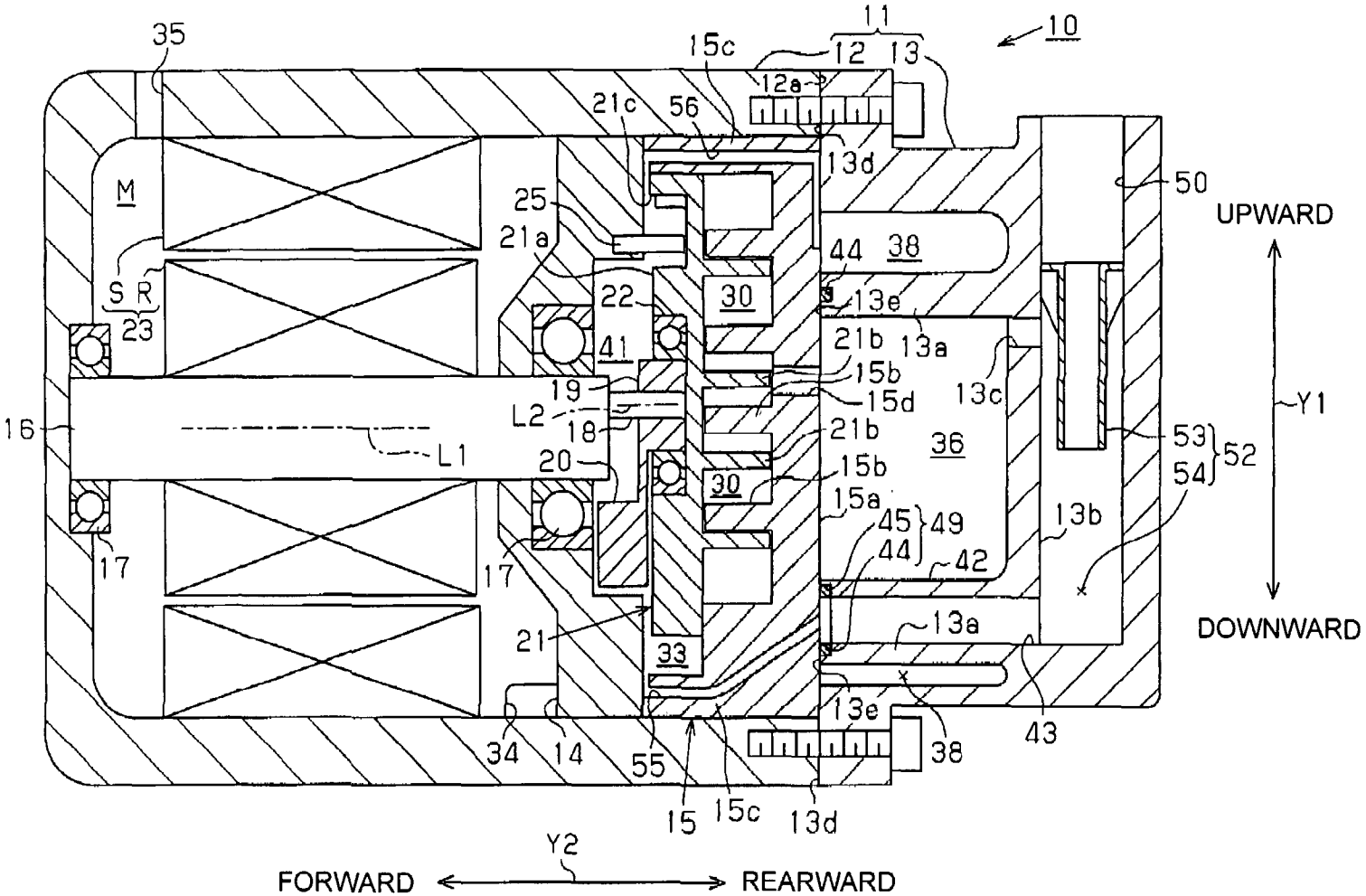
FIG. 1 is a schematic sectional view showing an electric scroll compressor according to a preferred embodiment of the present invention.

The following will describe a preferred embodiment of the present invention which is applied to an electric scroll compressor for an external refrigerant circuit of a vehicle air conditioning apparatus with reference to the drawings. In the following explanation, the direction indicated by arrow Y1 of FIG. 1 is a vertical direction of an electric scroll compressor 10 which includes upward and downward directions. Also, the direction indicated by arrow Y2 of FIG. 1 is a transverse direction of the electric scroll compressor 10 which includes forward and rearward directions. Carbon dioxide is used as a refrigerant for the external refrigerant circuit.

As shown in FIG. 1, a housing 11 of the electric scroll compressor 10 includes a front housing 12 and a rear housing 13. The front housing 12 and the rear housing 13 are joined to each other. A shaft support member 14 and a fixed scroll 15 are fixedly fitted in the housing 11. In detail, the shaft support member 14 and the fixed scroll 15 are located in the front housing 12 on the side of the rear housing 13 (or on the rear of the front housing 12). A rear end face 12*a* of the front housing 12 and a rear end face of a fixed scroll base plate 15*a* of the fixed scroll 15 are located in the same plane. A pair of radial bearings 17 provided in the front housing 12 and the shaft support member 14 supports opposite ends of a rotary shaft 16, respectively.

An eccentric shaft 18 is integrated with one end (the rear end) of the rotary shaft 16 which protrudes toward the fixed scroll 15 through the shaft support member 14. A central axis L2 of the eccentric shaft 18 is eccentric with respect to a central axis L1 of the rotary shaft 16. A bushing 19 is fitted onto the eccentric shaft 18 to be supported by the eccentric shaft 18. A balance weight 20 is integrated with the bushing 19. A movable scroll 21 is rotatably supported by a radial bearing 22 provided on the bushing 19 so as to face the fixed scroll 15. The radial bearing 22 is disposed in a cylindrical portion formed on a forward side of a movable scroll base plate 21*a* of the movable scroll 21 which faces the shaft support member 14.

The fixed scroll 15 includes a fixed scroll base plate 15*a*, an outer peripheral wall 15*c* and a fixed scroll spiral wall 15*b* that extends from the fixed scroll base plate 15*a* toward the movable scroll 21 inside the outer peripheral wall 15*c*. The movable scroll 21 includes the movable scroll base plate 21*a* and a movable scroll spiral wall 21*b* that extends from the movable scroll base plate 21*a* toward the fixed scroll 15. The fixed scroll base plate 15*a* and the fixed scroll spiral wall 15*b* of the fixed scroll 15 and the movable scroll base plate 21*a* and the movable scroll spiral wall 21*b* of the movable scroll 21 define a plurality of compression chambers 30 therebetween. The compression chambers 30 serves as a compression region. While the movable scroll 21 is orbited around the central axis of the fixed scroll 15 in accordance with the rotation of the rotary shaft 16, the balance weight 20 cancels centrifugal force caused by orbital motion of the movable scroll 21.

A plurality of cylindrical pins 25 for preventing the movable scroll 21 from rotating is fixedly mounted on the shaft support member 14. Although three or more pins are used in the present embodiment, only one pin is shown in FIG. 1. Meanwhile, the same number of circular holes 21*c* as the number of the pins 25 are arranged in a circumferential direction of the movable scroll base plate 21*a* of the movable scroll 21 for preventing the movable scroll 21 from rotating. One end of each pin 25 is inserted in the corresponding hole 21*c*.

The front housing 12 has a motor chamber M formed therein. In the motor chamber M, a stator S is fixedly fitted on the inner peripheral surface of the front housing 12 and a rotor R is fixedly mounted on the rotary shaft 16 to form an electric motor 23. The rotor R of the electric motor 23 and the rotary shaft 16 are integrally rotated by supplying a stator coil (not shown) of the stator S with current.

In the front housing 12, a suction chamber 33 is defined between the outer peripheral wall 15*c* of the fixed scroll 15 and the outermost peripheral portion of the movable scroll spiral wall 21*b* of the movable scroll 21. A suction passage 34 through which the motor chamber M is in communication with the suction chamber 33 is formed on the downside of the front housing 12. A suction port 35 through which the motor chamber M is in communication with the outside of the compressor 10 is formed at the end (or front end) of the front housing 12. An external piping (not shown) connected to an evaporator (not shown) of the external refrigerant circuit (not shown) is connected to the suction port 35. Therefore, low-pressure refrigerant gas is introduced from the external refrigerant circuit to the suction chamber 33 through the suction port 35, the motor chamber M and the suction passage 34.

In the front housing 12, a back pressure chamber 41 is defined on the front side of the movable scroll base plate 21*a* of the movable scroll 21 (on the side of the movable scroll 21 opposite to the fixed scroll 15). The back pressure chamber 41 is formed between the front surface of the movable scroll base plate 21*a* and the rear surface of the shaft support member 14 which faces the front surface of the movable scroll base plate 21*a*.

Figure 2:
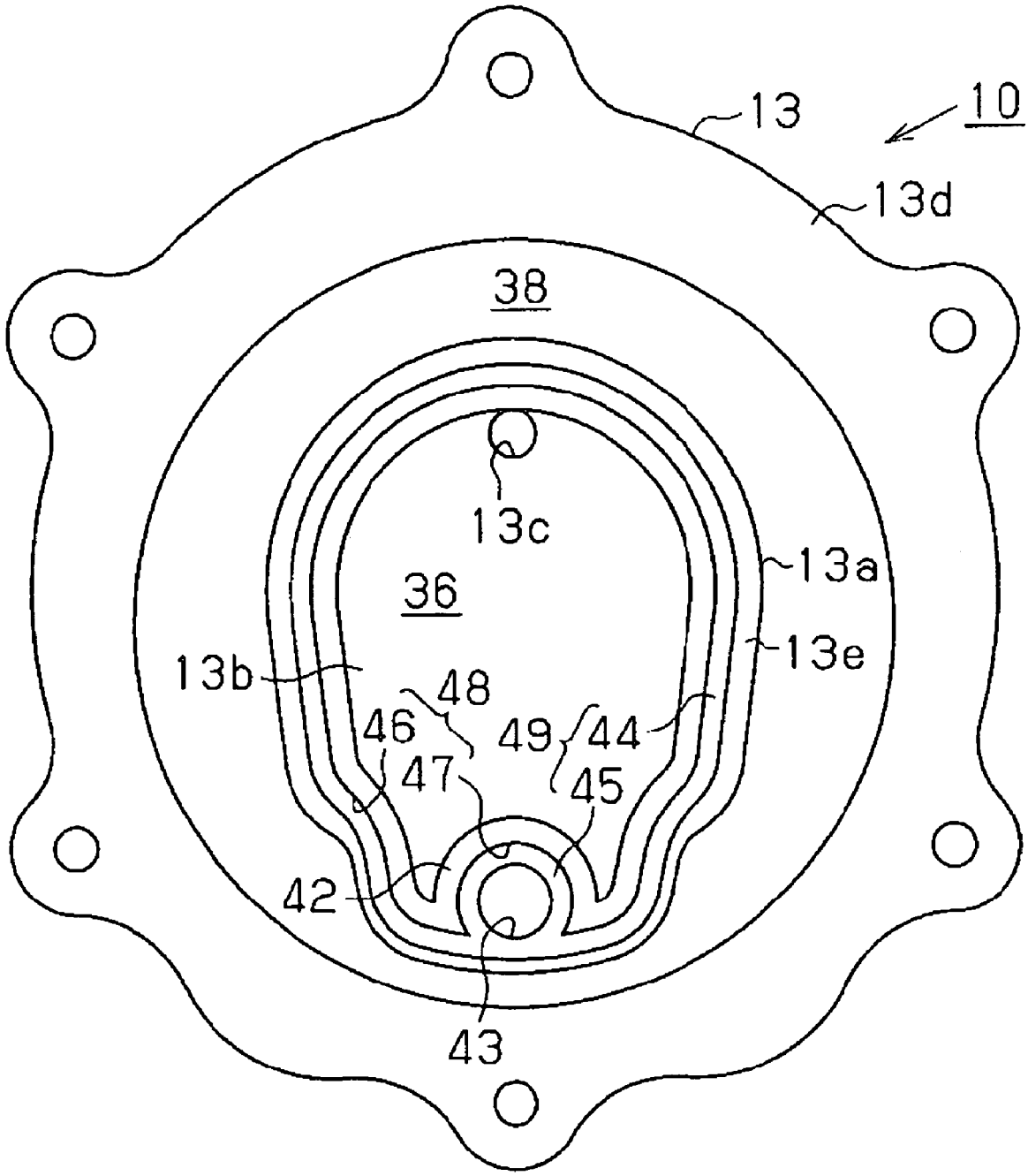
FIG. 2 is a front view showing a rear housing of the compressor.

In the rear housing 13, a partition wall 13*a* is formed for partitioning a space in the rear housing 13. The partition wall 13*a* has a cylindrical shape and is opened toward the fixed scroll base plate 15*a*. An end wall 13*b* is formed on the rear proximal end of the partition wall 13*a*. In the rear housing 13, a discharge chamber 36 is defined between the partition wall 13*a*, the end wall 13*b* and the fixed scroll base plate 15*a* of the fixed scroll 15. As shown in FIG. 2, an oil reservoir 38 is defined around the entire circumference of the partition wall 13*a* in the rear housing 13. In other words, the oil reservoir 38 is defined around the outer circumferential side of the discharge chamber 36 so as to surround the discharge chamber 36. That is, the rear housing 13 has the discharge chamber 36 formed inside the partition wall 13*a* that functions as a boundary and the oil reservoir 38 formed outside the partition wall 13*a*.

The discharge chamber 36 forms a part of discharge passage of the refrigerant gas from the compression chambers 30 to the external refrigerant circuit. As shown in FIG. 1, the fixed scroll base plate 15*a* of the fixed scroll 15 has a discharge port 15*d* formed substantially at the center thereof so as to extend through the fixed scroll base plate 15*a* in the transverse direction of the compressor 10. The innermost compression chamber 30 which is located substantially at the center of the fixed scroll 15 is in communication with the discharge chamber 36 through the discharge port 15*d*. In the discharge chamber 36, a discharge valve (not shown) formed by a reed valve for opening and closing the discharge port 15*d* is disposed to the fixed scroll 15.

The end wall 13*b* which forms the discharge chamber 36 has a discharge hole 13*c* formed therethrough. The rear housing 13 has a front end face 13*d* formed on the outer wall thereof and the end face 13*d* is joined to the rear end face 12*a* of the front housing 12. The rear housing 13 also has a front end face 13*e* formed on the inner wall thereof and the end face 13*e* is an end face of the partition wall 13*a* which is joined to the fixed scroll base plate 15*a* of the fixed scroll 15. The end face 13*d* and the end face 13*e* are located in the same plane. The housing 11 is so formed that a joint surface between the end face 12*a* of the front housing 12 and the end face 13*d* of the rear housing 13, and a joint surface between the fixed scroll base plate 15*a* of the fixed scroll 15 and the end face 13*e* of the rear housing 13 are located in the same plate.

As the rotary shaft 16 is rotated by the electric motor 23, the movable scroll 21 is orbited around the central axis of the fixed scroll 15 (or the central axis L1 of the rotary shaft 16) through the eccentric shaft 18. During the rotation of the rotary shaft 16, the outer circumferential surfaces of the pins 25 are contacted with the holes 21*c* to slide along the inner circumferential surfaces of the holes 21*c*, so that the rotation of the movable scroll 21 is prevented and the orbital movement of the movable scroll 21 is performed. By the orbital movement of the movable scroll 21, the compression chambers 30 on the outer peripheral side of the spiral walls 15*b*, 21*b* of both scrolls 15, 21 are moved toward the center side while decreasing in volume. Consequently, the refrigerant gas introduced from the suction chamber 33 into the compression chambers 30 is compressed. The refrigerant gas compressed by the reduction of the volume in the compression chambers 30 is discharged from the discharge port 15*d* into the discharge chamber 36 pushing the discharge valve away.

In the rear housing 13, the oil reservoir 38 is defined around the entire circumference of the discharge chamber 36 through the partition wall 13*a*. An oil separator 52 for separating lubricating oil contained in the refrigerant gas from the refrigerant gas is disposed in such a position of the rear housing 13 that the oil separator 52 and the fixed scroll base plate 15*a* of the fixed scroll 15 sandwich the discharge chamber 36. That is, the oil separator 52 is not formed around the discharge chamber 36 in the rear housing 13. Therefore, the oil reservoir 38 is so formed that the transverse length of the oil reservoir 38 along the axial direction of the rotary shaft 16 (the axial direction of the central axis L1) is substantially the same as the length of the discharge chamber 36 along the axial direction.

A connection passage 43 is formed on the bottom side of the rear housing 13 or on the lower portion of the partition wall 13*a* so as to extend through the partition wall 13*a* in the axial direction of the rotary shaft 16. That is, the connection passage 43 is formed in the housing 11. FIG. 2 is a front view showing (the front end side of) the rear housing 13 from the side of the fixed scroll base plate 15*a*. As shown in FIG. 2, a part of an outer wall 42 of the connection passage 43 is formed in the discharge chamber 36 so as to bulge into the discharge chamber 36. The connection passage 43 passes through the discharge chamber 36 and the outer wall 42 of the connection passage 43 is also used as a part of the partition wall 13*a*. An accommodation groove 48 is recessed in the end face 13*e* of the partition wall 13*a*.

The accommodation groove 48 includes a first accommodation groove 46 which is formed to be an annular groove in the end face 13*e* of the partition wall 13*a*, and a second accommodation groove 47 which is connected to the inside of the first accommodation groove 46 on the downside of the partition wall 13*a* and has a smaller diameter than the first accommodation groove 46. The second accommodation groove 47 is recessed in the end face 13*e* of the partition wall 13*a* and the outer wall 42 of the connection passage 43 along the outer periphery of the connection passage 43. In the accommodation groove 48, a seal unit 49 formed by an O-ring is fitted. The seal unit 49 includes a first seal member 44 and a second seal member 45. The first seal member 44 has a circular shape and is fitted in the first accommodation groove 46. The second seal member 45 is integrated with the inside of the first seal member 44 and has a smaller diameter than the first seal member 44 and is fitted in the second accommodation groove 47. That is, the seal unit 49 is so formed that a pair of O-rings (the first seal member 44 and the second seal member 45) having different diameters are integrated.

In the state where the seal unit 49 is fitted in the accommodation groove 48, the first seal member 44 is interposed in the radial direction of the rotary shaft 16 between the discharge chamber 36 and the oil reservoir 38 surrounding the discharge chamber 36, thereby preventing the discharge gas in the discharge chamber 36 from leaking into the oil reservoir 38. Also, the second seal member 45 is interposed in the radial direction of the rotary shaft 16 between the discharge chamber 36 and the connection passage 43 inside the discharge chamber 36, thereby preventing the refrigerant gas in the discharge chamber 36 from leaking into the connection passage 43.

As shown in FIG. 1, the rear housing 13 has a cylindrical accommodation chamber 50 that extends in the vertical direction thereof in the rear of the end wall 13*b*. The accommodation chamber 50 is connected with the external refrigerant circuit through an external piping (not shown) and forms a part of the discharge passage of the refrigerant gas. The accommodation chamber 50 is located on downstream side of the discharge chamber 36 and on upstream side of the external refrigerant circuit. The accommodation chamber 50 is a region which is lower in pressure than the discharge chamber 36. In the accommodation chamber 50, the oil separator 52 is accommodated for separating the lubricating oil contained in the refrigerant gas from the refrigerant gas.

That is, the oil separator 52 is accommodated in the accommodation chamber 50 which is formed separately from the discharge chamber 36 and is not located inside the discharge chamber 36. The discharge chamber 36 and the accommodation chamber 50 are formed so as to communication with each other through only the discharge hole 13*c* that extends through the end wall 13*b*. The discharge hole 13*c* forms a part of the discharge passage of the refrigerant gas. That is, the discharge chamber 36, the discharge hole 13*c* and the accommodation chamber 50 form the discharge passage in which the refrigerant gas discharged from the compression chambers 30 is discharged to the external refrigerant circuit, and the oil separator 52 is accommodated in the accommodation chamber 50 of the discharge passage.

The oil separator 52 is a centrifugal oil separator. The oil separator 52 includes a separation pipe 53 which is formed substantially in the middle of the accommodation chamber 50 and an oil reserved area 54 which is located on the lower side of the accommodation chamber 50 and is formed below the separation pipe 53. The separation pipe 53 serves as a separation member. The separation pipe 53 has a cylindrical shape and is joined to the inner circumferential surface on the upward side of the accommodation chamber 50 such that the separation pipe 53 and the accommodation chamber 50 are located coaxially.

In addition, the separation pipe 53 is so formed that the lower end thereof is opened to the oil reserved area 54 and the upper end thereof is opened to the external refrigerant circuit. Further, the separation pipe 53 is disposed in the accommodation chamber 50 such that the opening of the discharge hole 13*c* opens to the side face of the separation pipe 53. The refrigerant gas discharged from the discharge chamber 36 into the accommodation chamber 50 through the discharge hole 13*c* is circled around the separation pipe 53, thereby separating the lubricating oil from the refrigerant gas by the centrifugal separation caused by the circle action.

The lubricating oil which is separated from the refrigerant gas by centrifugal separation using the separation pipe 53 falls into the oil reserved area 54 thereby to be reserved on the oil reserved area 54 which is on the lower side of the accommodation chamber 50. The connection passage 43 is opened to the bottom of the oil reserved area 54 to be connected with the oil reserved area 54. The oil reserved area 54 of the above oil separator 52 is formed so as to communicate with the back pressure chamber 41 through an oil feeding passage which includes the connection passage 43, a communication passage 55 that extends through the outer peripheral wall 15*c* of the fixed scroll 15 in the transverse direction of the compressor 10, and an opening between the shaft support member 14 and the movable scroll 21. The lubricating oil reserved in the oil reserved area 54 is supplied into the back pressure chamber 41 which is lower in pressure than the accommodation chamber 50 through the oil feeding passage which includes the connection passage 43 passing through the discharge chamber 36 in the housing 11.

The oil reservoir 38 is formed so as to communicate with the back pressure chamber 41 through an oil extraction passage 56 that extends through the outer peripheral wall 15*c* of the fixed scroll 15 in the transverse direction of the compressor 10. The lubricating oil in the back pressure chamber 41 is supplied into the oil reservoir 38 which is lower in pressure than the back pressure chamber 41 through the oil extraction passage 56. Therefore, the oil reserved area 54 of the oil separator 52 and the oil reservoir 38 are formed so as to communicate with each other through the oil feeding passage, the back pressure chamber 41 and the oil extraction passage 56. In addition, an oil return passage (not shown) is formed on the lower part of the fixed scroll base plate 15*a* of the fixed scroll 15 such that the oil reservoir 38 communicates with the suction chamber 33. Meanwhile, a gas return passage (not shown) extends through the upper part of the fixed scroll base plate 15*a* in order to draw the refrigerant gas separated from the lubricating oil reserved in the oil reservoir 38 into the suction chamber 33.

In the above-described electric scroll compressor 10, high-pressure refrigerant gas compressed in the compression chambers 30 is discharged into the discharge chamber 36. The second seal member 45 is interposed between the discharge chamber 36 and the connection passage 43, thereby preventing the high-pressure refrigerant gas from leaking into the connection passage 43 (the oil feeding passage) which is lower in pressure than the discharge chamber 36. In addition, the first seal member 44 is interposed between the discharge chamber 36 and the oil reservoir 38, thereby preventing the high-pressure refrigerant gas from leaking into the oil reservoir 38 which is lower in pressure than the discharge chamber 36.

The refrigerant gas discharged into the discharge chamber 36 is discharged through the discharge hole 13*c* into the accommodation chamber 50 which is higher in pressure than the connection passage 43 and the oil reservoir 38. At this time, the discharge hole 13*c* serves as a throttle to decrease the sectional area of passage of the refrigerant gas through the throttle, thereby accelerating the speed of the refrigerant gas discharged into the accommodation chamber 50. Consequently, the refrigerant gas is circled around the separation pipe 53 of the oil separator 52 at high speed thereby to efficiently separate the lubricating oil contained in the refrigerant gas from the refrigerant gas.

The refrigerant gas from which the lubricating oil is separated passes through the inside of the separation pipe 53 from the opening of the lower end of the separation pipe 53, and is led from the opening of the upper end of the separation pipe 53 to the external refrigerant circuit through the upper side of the accommodation chamber 50. Meanwhile, the lubricating oil which is separated from the refrigerant gas falls into the oil reserved area 54 to be reserved in the oil reserved area 54. The lubricating oil reserved in the oil reserved area 54 together with a small amount of the refrigerant gas led into the oil reserved area 54 is supplied into the back pressure chamber 41 which is lower in pressure than the accommodation chamber 50 through the oil feeding passage including the connection passage 43 and the communication passage 55. Thus, the pressure in the back pressure chamber 41 is adjusted, so that the force (caused by the small amount of the refrigerant gas) opposing the force caused by the pressure in the compression chambers 30 is applied to the movable scroll 21. Consequently, sliding resistance between the movable scroll base plate 21*a* of the movable scroll 21 and the shaft support member 14 on which the movable scroll base plate 21*a* slides is reduced.

Also, the lubricating oil supplied into the back pressure chamber 41 lubricates a drive mechanism for orbital motion of the movable scroll 21. In addition, the lubricating oil in the back pressure chamber 41 is supplied through the oil extraction passage 56 into the oil reservoir 38 which is lower in pressure than the back pressure chamber 41. It is noted that the oil reservoir 38 of the rear housing 13 is formed around the entire circumference of the discharge chamber 36, in addition, the length of the oil reservoir 38 along the axial direction of the rotary shaft 16 is substantially the same as the length of the discharge chamber 36 along the axial direction. That is, the depth of the oil reservoir 38 is substantially the same as that of the discharge chamber 36. Thus, the oil reservoir 38 is formed so as to have large volume, thereby enabling a large amount of lubricating oil to be reserved. Consequently, the large amount of lubricating oil separated from the refrigerant gas in the oil separator 52 is not overflowed from the oil reservoir 38, but is reserved into the oil reservoir 38.

The large amount of lubricating oil reserved in the oil reservoir 38 is drawn into the suction chamber 33 through the oil return passage by the suction action caused by the orbital movement of the movable scroll 21. The lubricating oil drawn into the suction chamber 33 is introduced into the compression chambers 30 together with the refrigerant gas to lubricate the sliding surfaces in the compression chambers 30. The refrigerant gas separated from the lubricating oil is drawn from the gas return passage into the suction chamber 33.

The scroll compressor of the present embodiment has the following beneficial effects.

(1) The rear housing 13 has the partition wall 13*a* formed therein to define the discharge chamber 36 on the inner circumferential side of the partition wall 13*a* and to define the oil reservoir 38 around the entire circumference of the partition wall 13*a*. Therefore, compared to the case where a region on the outer circumferential side of the discharge chamber is partly occupied by the suction passage and the remaining region on the outer circumferential side of the discharge chamber is occupied by the oil reservoir as described in the "BACKGROUND OF THE INVENTION", the volume of the oil reservoir 38 which is secured in the region on the outer circumferential side of the discharge chamber 36 is increased. Thus, even when the oil separator 52 formed by such a centrifugal separator to efficiently separate the lubricating oil from the refrigerant gas as described in the above-described embodiment is applied, the large amount of lubricating oil is reserved in the oil reservoir 38. That is, overflow of the lubricating oil separated from the oil reservoir 38 is prevented, thereby preventing the lubricating oil in the oil reserved area 54 from being brought into the external refrigerant circuit. Since the large amount of lubricating oil is reserved in the oil reservoir 38, the large amount of lubricating oil is supplied to the compression chambers 30 and the drive mechanism for orbital motion of the movable scroll 21 to be lubricated. This enables the electric scroll compressor 10 to be smoothly driven.

(2) The second seal member 45 is interposed between the discharge chamber 36 and the connection passage 43, and the first seal member 44 is interposed between the discharge chamber 36 and the oil reservoir 38. Therefore, the refrigerant gas discharged from the compression chambers 30 to the discharge chamber 36 is not leaked into the connection passage 43 and the oil reservoir 38 which are lower in pressure than the discharge chamber 36, but is led to the accommodation chamber 50, thereby enabling the oil separator 52 to reliably separating the lubricating oil from the refrigerant gas.

(3) In the oil feeding passage through which the back pressure chamber 41 communicates with the oil reserved area 54, the connection passage 43 which is defined in the housing 11 (the rear housing 13) and which passes through the discharge chamber 36 in the housing 11 (the rear housing 13) is formed so as to extend through the inner side of the partition wall 13*a* in the axial direction of the rotary shaft 16. That is, since the outer wall 42 of the connection passage 43 is also used as a part of the partition wall 13*a*, the space in the housing 11 (the rear housing 13) is effectively used. Therefore, for example, compared to the case where the connection passage 43 is formed so as to pass through the oil reservoir 38, the reduction of the volume of the oil reservoir 38 due to the connection passage 43 is prevented. In addition, compared to the case where the outer wall 42 of the connection passage 43 is formed in the discharge chamber 36 separately from the partition wall 13*a*, the reduction of the volume of the discharge chamber 36 due to the outer wall 42 of the connection passage 43 is eliminated. Therefore, the amount of lubricating oil reserved in the oil reservoir 38 is increased and at the same time the efficiency of the electric scroll compressor 10 is improved.

(4) The seal unit 49 is formed by integrating the first seal member 44 with the second seal member 45. Therefore, when the electric scroll compressor 10 is assembled, a single seal unit 49 is easily provided onto the rear housing 13. That is, compared to the case where the first seal member 44 and the second seal member 45 of the seal unit 49 are separately formed and each of the seal members 44, 45 is independently provided onto the rear housing 13, the electric scroll compressor 10 is easily manufactured. In addition, overlooking to provide the seal member 44 or 45 onto the rear housing 13 is eliminated. Therefore, generation of inconvenience, which is caused by the overlooking found due to unwanted function caused by the leakage of the discharge gas after manufacturing the electric scroll compressor 10, is eliminated.

(5) The end face 13*d* of the rear housing 13 which is joined to the rear end face 12*a* of the front housing 12 and the end face 13*e* of the partition wall 13*a* which is joined to the fixed scroll base plate 15*a* of the fixed scroll 15 are located in the same plane. Thus, in order that the front housing 12 is joined to the rear housing 13, it is only necessary to locate the end face 12*a* and the fixed scroll base plate 15*a* in the same plane in the front housing 12. Therefore, compared to the case, for example, where the end face 13*d* and the end face 13*e* of the rear housing 13 are not located in the same plane, there is no need to position the end face 12*a* of the front housing 12 and the fixed scroll base plate 15*a* of the rear housing 15 so as to join the end faces 13*d*, 13*e*, respectively, thereby facilitating fixing operation of the fixed scroll 15 into the front housing 12. Consequently, the joint surfaces of the front housing 12 and the rear housing 13 are easily positioned, thereby facilitating assembly operation of the front housing 12 and the rear housing 13. At the same time, a seal between the joint surfaces of the front housing 12 and the rear housing 13 is reliably performed. In addition, compared to the case, for example, where the end face 13*e* of the partition wall 13*a* is formed so as to be closer to the front housing 12 than the end face 13*d*, the rear housing 13 is easily manufactured.

The above embodiments may be modified as follows.

Figure 3:
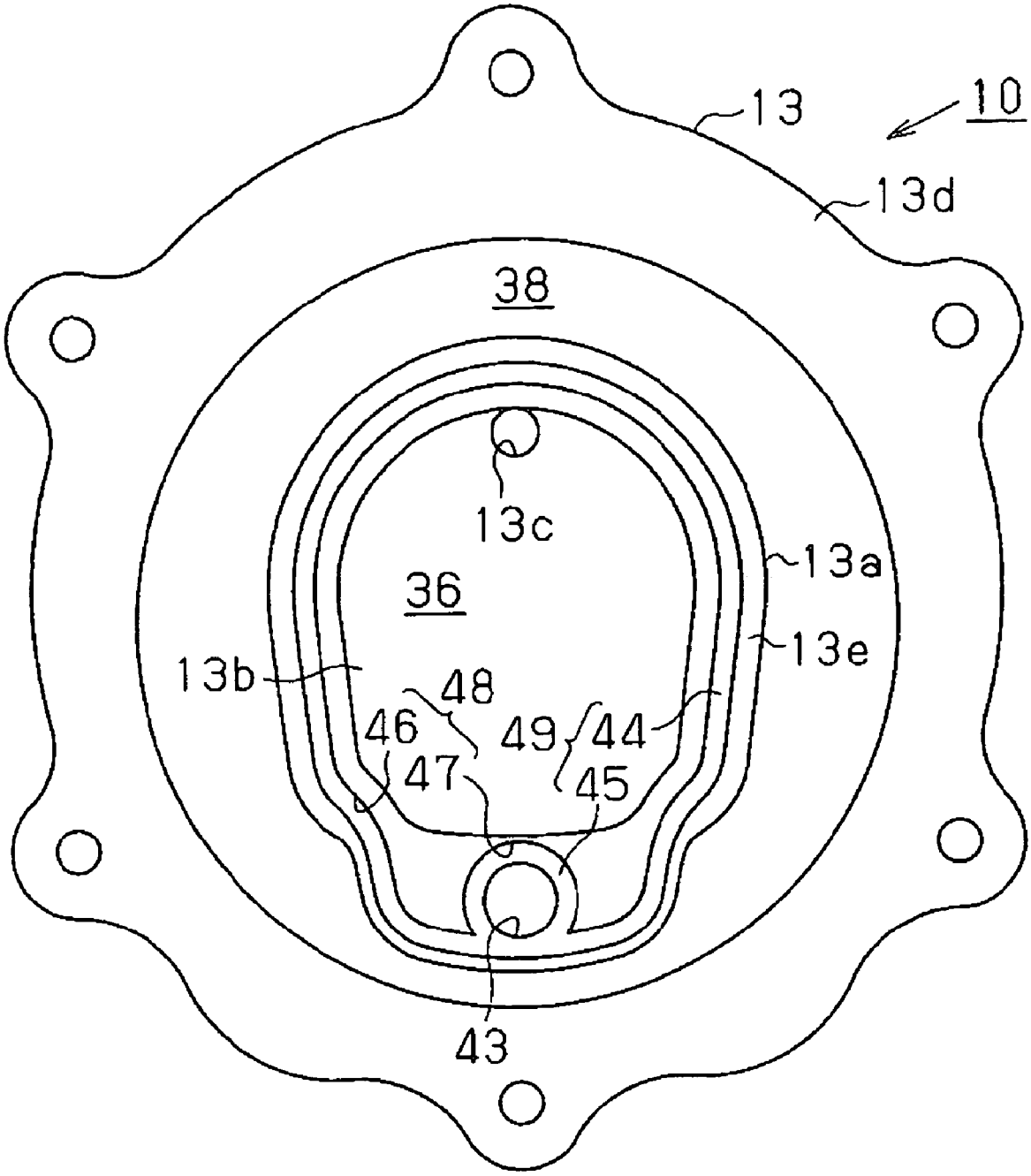
FIG. 3 is a front view showing a rear housing of an electric scroll compressor according to another embodiment of the present invention.

In the embodiment, as shown in FIG. 3, the outer wall 42 of the connection passage 43 may be included in the partition wall 13*a*. In this structure, the rear housing 13 is easily manufactured.

In the embodiment, the oil separator 52 is not limited to the centrifugal oil separator, but may be an inertia oil separator which separates the lubricating oil from the refrigerant gas, for example, by bringing the refrigerant gas to collide with the wall surface of the accommodation chamber 50. That is, the oil separator may be comprised from the wall surface of the accommodation chamber 50 or the oil reserved area 54 that serves as the separation member.

In the embodiment, the length (depth) of the oil reservoir 38 along the axial direction of the rotary shaft 16 may be formed so as to be shorter than that of the discharge chamber 36 along the axial direction.

In the embodiment, the first seal member 44 and the second seal member 45 of the seal unit 49 may be separately formed. In this case, the first accommodation groove 46 and the second accommodation groove 47 formed in the partition wall 13*a* do not communicate with each other, but are separately formed.

In the embodiment, the oil reserved area 54 of the oil separator 52 may have a filter formed therein.

In the embodiment, the discharge hole 13*c* may not be necessarily formed in the lateral position of the separation pipe 53. For example, the discharge hole 13*c* may be formed in a position below the separation pipe 53.

In the embodiment, the discharge hole 13*c* may have a variable throttle formed in the inner circumferential surface thereof. In this structure, the sectional area for passage of the refrigerant gas through the discharge hole 13*c* can be increased in accordance with the increase of the flow rate of the refrigerant gas. When the flow rate of the refrigerant gas is large, the sectional area for passage of the refrigerant gas through the discharge hole 13*c* can be increased, thereby decreasing pressure loss due to the throttle and improving efficiency of the external refrigerant circuit. When the flow rate of the refrigerant gas is small, on the other hand, the sectional area for passage of the refrigerant gas through the discharge hole 13*c* can be decreased, thereby clarifying variation of the pressure differential between upstream and downstream of the throttle against the variation of the flow rate, which maintains to accelerate the speed of the refrigerant gas. That is, even when the flow rate of refrigerant gas is small, the performance of the oil separator 52 for separates the lubricating oil from the refrigerant gas is highly maintained.

In the embodiment, chlorofluorocarbon may be used for the refrigerant gas.

Although illustrative embodiments of the present invention, and various modifications thereof, have been described in detail herein with reference to the accompanying drawings, it is to be understood that the invention is not limited to these precise embodiments and the described modifications, and that various changes and further modifications may be effected therein by one skilled in the art without departing from the scope or spirit of the invention as defined in the appended claims.

What is claimed is:

1. A scroll compressor for compressing refrigerant gas containing lubricating oil comprising:

a housing having a front housing and a rear housing which has a partition wall, the housing also having a suction chamber;

a discharge passage formed in the housing, the discharge passage having a discharge chamber, a discharge hole and an accommodation chamber, wherein the discharge chamber and the accommodation chamber are communicated with each other through the discharge hole;

a rotary shaft rotatably supported by the housing;

a fixed scroll disposed in the housing, the fixed scroll having a fixed scroll base plate and a fixed scroll spiral wall that extends from the fixed scroll base plate;

a movable scroll also disposed in the housing for facing the fixed scroll, the movable scroll having a movable scroll base plate and a movable scroll spiral wall that extends from the movable scroll base plate, wherein the movable scroll base plate and the movable scroll spiral wall of the movable scroll and the fixed scroll base plate and the fixed scroll spiral wall of the fixed scroll define a compression region therebetween;

an oil separator provided in the accommodation chamber, the oil separator having a separation member and an oil reserved area; and an oil reservoir defined around an entire circumference of the partition wall which defines the discharge chamber therein, the oil reservoir being formed so as to communicate with the oil reserved area of the oil separator, wherein a back pressure chamber is defined in the movable scroll on the opposite side of the fixed scroll, the back pressure chamber being formed so as to communicate with the oil reserved area of the oil separator through an oil feeding passage, at least a part of a wall which forms the oil feeding passage in the rear housing being also used as a part of the partition wall.

2. The scroll compressor according to claim 1, wherein the oil feeding passage includes a connection passage, the wall of the connection passage being formed in the discharge chamber, the connection passage being formed so as to pass through the discharge chamber.

3. The scroll compressor according to claim 1, wherein the oil feeding passage includes a connection passage, the wall of the connection passage being included in the partition wall.

4. The scroll compressor according to claim 1, wherein the oil feeding passage includes a connection passage, the back pressure chamber being formed so as to communicate with the oil reservoir through an oil extraction passage, the compressor further comprising a first seal member for sealing between the discharge chamber and the oil reservoir, and a second sealing member for sealing between the connection passage and the discharge chamber.

5. The scroll compressor according to claim 4, wherein the first seal member is integrated with the second seal member.

6. The scroll compressor according to claim 4, wherein the first seal member has a circular shape, the second seal member being integrated with the inside of the first seal member and having a smaller diameter than the first seal member.

7. The scroll compressor according to claim 1, wherein the rear housing has an end face formed on an outer peripheral wall thereof and an end face formed on the partition wall, both of the end faces being located in the same plane.

8. The scroll compressor according to claim 1, wherein the oil separator is composed by a centrifugal separator.

9. The scroll compressor according to claim 1, wherein carbon dioxide is used as the refrigerant gas.

* * * * *